US006263629B1

(12) United States Patent
Brown, Jr.

(10) Patent No.: US 6,263,629 B1
(45) Date of Patent: Jul. 24, 2001

(54) STRUCTURAL REINFORCEMENT MEMBER AND METHOD OF UTILIZING THE SAME TO REINFORCE A PRODUCT

(75) Inventor: Gordon L. Brown, Jr., Anderson, SC (US)

(73) Assignee: Clark Schwebel Tech-Fab Company, Anderson, SC (US)

( * ) Notice: Subject to any disclaimer, the term of this patent is extended or adjusted under 35 U.S.C. 154(b) by 0 days.

(21) Appl. No.: 09/422,701

(22) Filed: Oct. 21, 1999

Related U.S. Application Data

(63) Continuation-in-part of application No. 09/129,058, filed on Aug. 4, 1998.

(51) Int. Cl.[7] ..... E01C 11/16; E04C 5/07

(52) U.S. Cl. ..... 52/309.16; 52/309.17; 52/408; 52/454; 52/660; 442/58; 442/59; 442/179; 442/180

(58) Field of Search ..... 52/309.16, 309.17, 52/309.15, 408, 454, 660, 745.19, 745.2, 745.21; 264/258; 404/134; 442/59, 50, 52, 58, 179, 180

(56) References Cited

U.S. PATENT DOCUMENTS

| | | |
|---|---|---|
| 890,011 | 6/1908 | Anderson . |
| 1,891,837 | 12/1932 | Pittman . |
| 2,312,293 | 2/1943 | Weiss . |
| 3,567,816 | 3/1971 | Embree . |
| 3,597,890 | 8/1971 | Hala . |
| 4,019,297 | 4/1977 | Murphy . |
| 4,229,497 | 10/1980 | Piazza . |
| 4,233,787 | 11/1980 | Piazza . |
| 4,612,748 | 9/1986 | Arnold et al. . |
| 4,617,219 | 10/1986 | Schupack . |
| 4,841,702 | 6/1989 | Huettemann . |
| 4,916,004 | 4/1990 | Ensminger et al. . |
| 4,934,121 | 6/1990 | Zimmerman . |
| 5,032,340 | 7/1991 | Akihama et al. . |
| 5,246,306 | 9/1993 | Shoesmith et al. . |
| 5,317,848 | 6/1994 | Abbey . |
| 5,493,836 | 2/1996 | Lopez-Munoz . |
| 5,640,825 | 6/1997 | Ebsani et al. . |
| 5,836,715 | 11/1998 | Hendrix et al. . |
| 6,054,205 * | 4/2000 | Newman et al. ..... 442/50 X |

FOREIGN PATENT DOCUMENTS

| | | |
|---|---|---|
| 114294 | 12/1941 | (AU) . |
| 0 016 478 A2 | 10/1980 | (EP) . |
| 0 297 006 A1 | 12/1988 | (EP) . |
| 0 387 968 A1 | 9/1990 | (EP) . |
| 0 637 658 A1 | 2/1995 | (EP) . |
| 545526 | 6/1942 | (GB) . |
| 2 201 175 A | 8/1988 | (GB) . |

* cited by examiner

*Primary Examiner*—Laura A. Callo
(74) *Attorney, Agent, or Firm*—Alston & Bird LLP

(57) ABSTRACT

A reinforcing grid which advantageously includes fibers of both a first type and a second type is provided. The first type of fibers have a strength sufficient to reinforce the hardenable structural material, such as concrete, after hardening. The first type of fibers also have a higher resistance to degradation in the hardenable material than the second type of fibers. As such, the first type of fibers will continue to reinforce the hardened material in the event the fibers of the second type become corroded in the hardened material. Consequently, a less expensive type of fiber can be used as the second type of fiber and can corrode in the hardenable material without concern for the strength of the hardened structural product. According to one embodiment, the first type of fibers comprises carbon fibers and the second type of fibers comprises glass fibers.

20 Claims, 4 Drawing Sheets

FIG. 1.
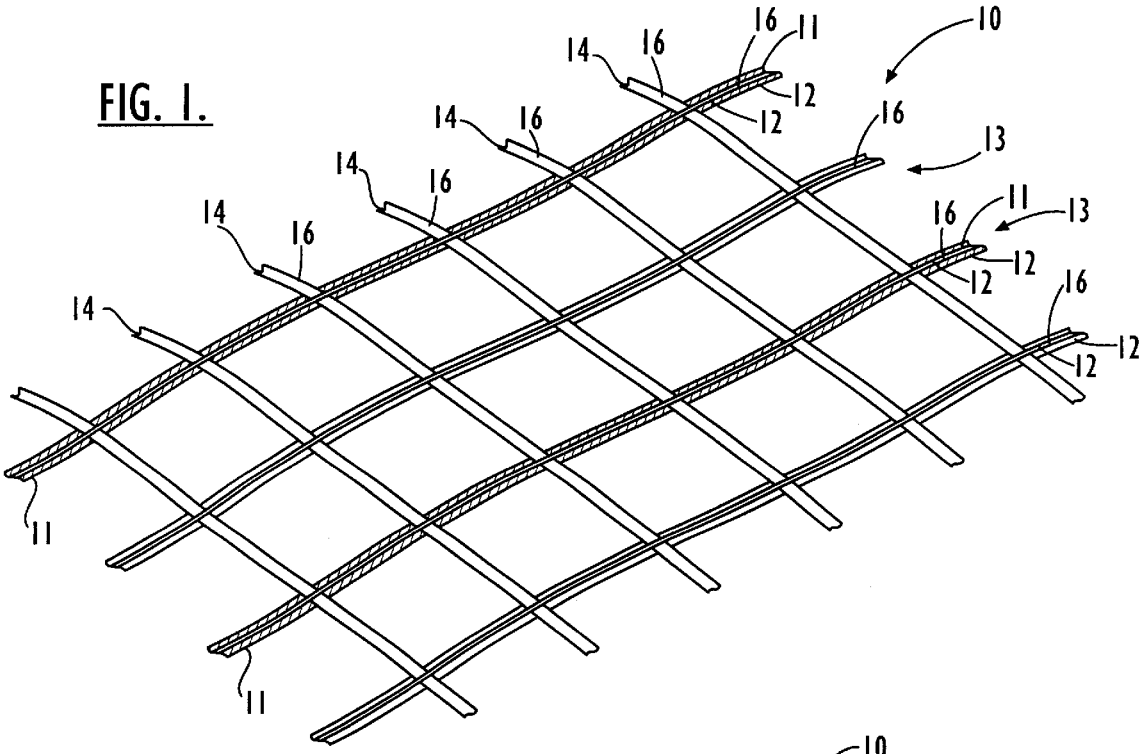
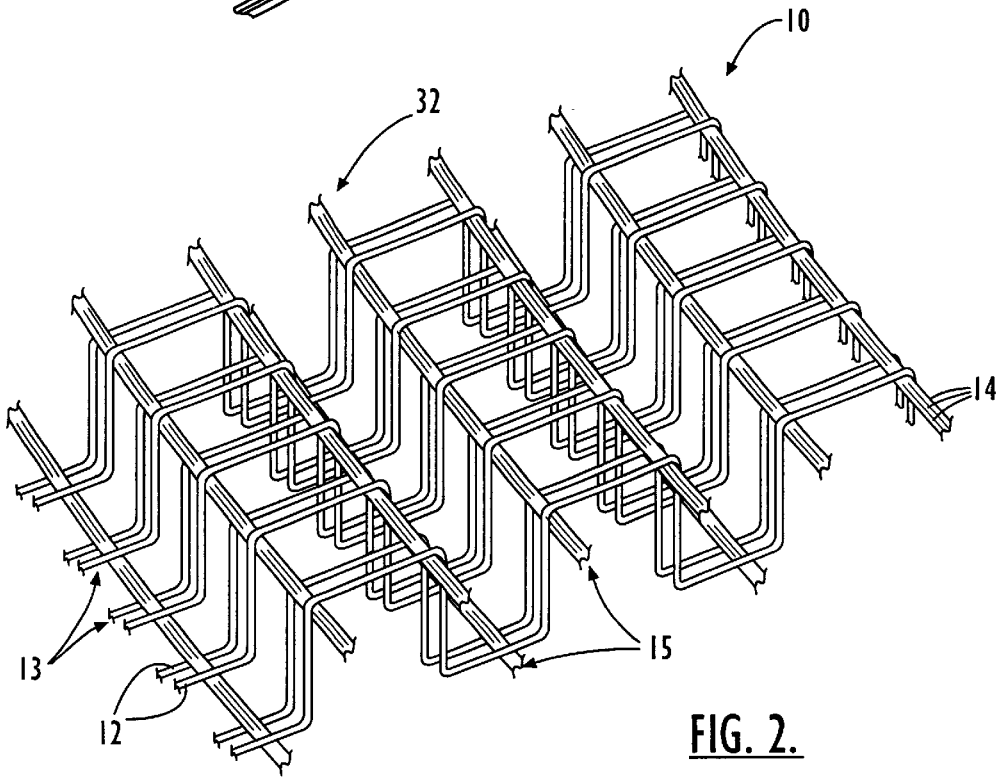
FIG. 2.

STRUCTURAL REINFORCEMENT MEMBER AND METHOD OF UTILIZING THE SAME TO REINFORCE A PRODUCT

CROSS-REFERENCE TO RELATED APPLICATIONS

The present application is a continuation-in-part of U.S. patent application Ser. No. 09/129,058 filed Aug. 4, 1998, pending, and which is incorporated herein by reference.

FIELD OF THE INVENTION

The present invention generally relates to structural members adapted to reinforce a product. The present invention also relates to methods of utilizing the structural member to form reinforced products.

BACKGROUND OF THE INVENTION

Structures formed of concrete and other masonry or cementitious materials often require reinforcement in their construction. These concrete materials have low tensile strength yet have good compressive strength. When using concrete as a structural member, for example, in a bridge, building or the like, reinforcement is often used to impart the necessary tensile strength. In new and existing concrete structures, such as precast driveways, slabs, sidewalks, pipe etc., reinforcement has been undertaken with a variety of steel shapes such as open steel meshes, steel rebar, and steel grids. Steel grids have been used in reinforcing concrete structures such as decking for drawbridges. These steel grids are a closed cell structure, and each section of steel grid contains and confines a rectangular or square column of concrete. These types of grids are inherently very inefficient in their use of the reinforcing material.

Steel and other metals used as a reinforcing agent are subject to corrosion. The products of corrosion result in an expansion of the column of the steel which causes a "spalling" effect which can cause a breakup and deterioration of the concrete structure. This breaking and crumbling of concrete structures is severe in areas of high humidity and areas where salt is used frequently on roads, driveways and sidewalks to melt ice or snow. Bridges over waterways in areas such as the Florida coast or Florida Keys are exposed to ocean air which causes deterioration and a short lifespan requiring constant rebuilding of these bridges. Concrete structures in the Middle East use concrete made with the local acidic sand which also causes corrosion of steel reinforcements.

In addition, because of the potential for spalling due to corroded metal reinforcing members, such configurations typically require a minimum of one inch or more of "cover" meaning that the steel reinforcing members are spaced at least about one inch from the surface of the concrete. This requires that the design thickness of concrete members, such as panels, must be of a certain minimum thickness, usually about three inches, to allow for the thickness of the steel reinforcing member and about one inch of concrete on either side of the reinforcing member. This minimum thickness to avoid spalling causes certain design constraints and requires a relatively high weight per square foot of surface area of the panel.

To replace traditional steel in reinforcing concrete, many types of plastics have been considered. One attempted replacement for steel in reinforcement uses steel rebars coated with epoxy resin. Complete coating coverage of the steel with epoxy, however, is difficult. Also, due to the harsh handling conditions in the field, the surface of the epoxy coated steel rebars frequently will be nicked. This nicking results in the promotion of localized, aggressive corrosion of the steel and results in the same problems as described above.

Fiberglass composite rebars have been used in reinforcing concrete structures such as the walls and floors of x-ray rooms in hospitals where metallic forms of reinforcement are not permitted. The method of use is similar to steel rebars. The fiberglass composite rebars have longitudinal discrete forms which are configured into matrixes using manual labor. Concrete is then poured onto this matrix structure arrangement.

Fiberglass composite rebars are similar to steel rebars in that the surface is deformed. Fiberglass gratings which are similar to steel walkway gratings also have been used as reinforcements in concrete, but their construction, which forms solid walls, does not allow the free movement of matrix material. This is due to the fact that the "Z" axis or vertical axis reinforcements form solid walls.

In dealing with reinforcing concrete support columns or structures, wraps have been applied around the columns to act like girdles and prevent the concrete from expanding and crumbling. Concrete is not a ductile material, thus, this type of reinforcing is for only the external portion of the column. One type of wrap consists of wrapping a fabric impregnated with a liquid thermosetting resin around the columns. The typical construction of these wraps has glass fiber in the hoop direction of the column and glass and Kevlar fibers in the column length direction. Another approach uses carbon fiber unidirectional (hoop direction) impregnated strips or strands which are designed to be wound under tension around deteriorated columns. The resulting composite is cured in place using an external heat source. In these approaches the materials used in the reinforcing wraps are essentially applied to the concrete column in an uncured state, although a prepreg substrate may be employed which is in a "semi-cured" state, i.e. cured to the B-stage. When using a woven fabric, "kinking" can take place when using either carbon or glass fibers, because the weaving process induces inherent "kinks" in either a woven wet laminate or woven prepreg, which results in a less than perfectly straight fiber being wrapped around the column.

Another approach to reinforcing concrete structures and columns is to weld steel plates around the concrete columns to give support to the concrete wall. Such steel plates are also subject to corrosion and loosening resulting from deterioration of the column being supported. This approach is only an external reinforcement and lacks an acceptable aesthetic appearance which makes it undesirable.

An approach to reinforcing concrete mixes has been using short (¼ to 1") steel, nylon or polypropylene fibers. Bare "E-type" glass fibers are generally not used due to the susceptibility of glass fibers to alkaline attack in Portland cement.

An exemplary structural reinforcing member for asphalt and concrete roadways and other structures is provided in U.S. Pat. No. 5,836,715, which is incorporated herein by reference. The reinforcing member disclosed therein comprises a gridwork having a set of warp strands and a set of weft strands disposed at substantially right angles to each other. The gridwork is impregnated substantially throughout with a resin so as to interlock the strands at their crossover points. The set of warp strands is separated into groups each containing a plurality of contiguous strands, with at least one strand of each group lying on one side of the set of weft strands, and at least one other strand of each group lying on the other side of the set of weft strands in contiguous superimposed relationship with the other strand of the group on the other side of the weft strands. The strands may be composed of glass (suitably E-type glass), carbon, aramid, or nylon. As noted above, however, the use of glass fibers in cementitious materials can be difficult because of the susceptibility of glass fibers to alkaline attack in Portland cement. In addition, others of the fibers disclosed by the patent have individual disadvantages such as the relatively high cost of carbon, notwithstanding its exceptional strength and resistance to alkaline attack in concrete.

Thus, there is a need for improved structural members adapted to reinforce a variety of products. For example, there continues to be a need for a structural reinforcement member for concrete structures which accomplishes the reinforcement or increases material properties of the concrete structure without being subject to corrosion or attack. Such a structural reinforcement member would preferably not only be resistant to corrosion or attack, but would also be relatively inexpensive. There also remains a need for methods to reinforce products using these structural members.

It is an object of the invention to overcome the deficiencies of the prior art as noted. A more particular object of this invention is to provide a structural member adapted to effectively reinforce a variety of different products, including relatively thin walled concrete panels. A further object of the invention is to provide methods for utilizing the structural member adapted to reinforce a product, and for efficiently producing the structural member.

SUMMARY OF THE INVENTION

The above and other objects and advantages of the present invention are achieved by the reinforcing grid of the present invention which advantageously includes fibers of both a first type and a second type. The first type of fibers have a strength sufficient to reinforce the hardenable structural material, such as concrete, after hardening. The first type of fibers also have a higher resistance to degradation in the hardenable material than the second type of fibers. As such, the first type of fibers will continue to reinforce the hardened material in the event the fibers of the second type become corroded in the hardened material. Consequently, a less expensive type of fiber can be used as the second type of fiber and can corrode in the hardenable material without concern for the strength of the hardened structural product.

More particularly, the present invention includes a structural member for reinforcing a product formed of a hardenable, structural material after hardening of the material. The hardenable material can be conventional concrete, asphalt or polymer concrete. The structural member is in the form of a reinforcing grid and includes a set of warp strands wherein at least some of the strands are spaced apart. The warp strands are formed of fibers of at least one of the first type of fibers and the second type of fibers. As noted above, the first type of fibers have a strength sufficient to reinforce the hardenable material after hardening and a higher resistance to degradation in the hardenable material than the second type of fibers. According to one embodiment of the invention, the fibers of the first type comprise carbon fibers and the fibers of the second type comprise glass fibers. The carbon fibers have a strength sufficient to reinforce the hardenable material after hardening. Conversely, the glass fibers may corrode in the hardenable material, but are much less expensive than the carbon fibers.

The grid also includes a set of weft strands wherein at least some of the strands are spaced apart and are disposed at substantially right angles to the set of warp strands to define an open structure through which the hardenable material can pass before hardening. The weft strands are also formed of at least one of the first and second types of fibers such that the gridwork is partially formed of fibers of the first type which will continue to reinforce the hardened material in the event the fibers of the second type become corroded in the hardened material.

The set of warp strands can be separated into groups each containing a plurality of contiguous strands, with at least one strand of each group lying on one side of the set of weft strands and at least one other strand of each group lying on the other side of the set of weft strands. In particular, the warp strand lying on one side of the weft strands can comprise fibers of the first type and the warp strand lying on the other side of the weft strands can comprise fibers of the second type.

The grid according to one embodiment is impregnated substantially throughout with a thermosettable B-stage resin so as to interlock the strands at the crossover points of the strands and maintain the grid in a semi-flexible state which permits the grid to conform to the shape of the product to be reinforced. The thermoset resin may further be fully cured before use so as to interlock the strands at the crossover points of the strands and maintain the grid in a relatively rigid state.

One particularly useful application of the reinforcing grid is in thin wall products made of concrete. The grid advantageously allows the thin wall panel to have a thickness of less than about three inches. Associated methods also form a part of the invention.

The present invention thus provides a reinforcing member for concrete and asphalt which is both strong and relatively inexpensive. The carbon fibers of the first type provide the necessary strength to reinforce the hardenable material after it is hardened, whereas the glass fibers of the second type provide structure to the reinforcing grid before it is embedded in the hardenable material. Because of the durability and strength of the fibers of the first type, the fibers of the second type can be less expensive and concerns about corrosion of these fibers are obviated.

BRIEF DESCRIPTION OF THE DRAWINGS

FIG. 1 is a perspective view of a structural reinforcement member comprising one embodiment of the present invention.

FIG. 2 is a perspective view of a structural member adapted to reinforce a product comprising another embodiment of the present invention.

DETAILED DESCRIPTION OF THE INVENTION

The present invention will now be described in detail hereinafter by reference to the accompanying drawings. The invention is not intended to be limited to the embodiments described; rather, this detailed description is included to enable any person skilled in the art to make and use the invention.

In FIG. 1, a structural reinforcement member for reinforcing a product is shown which embodies the present invention. This structural member can be used to reinforce products formed of a hardenable structural material, such as concrete or asphalt, by placing the structural member in the hardenable material before hardening of the material. The structural member comprises a gridwork 10 comprising a set of warp strands 12 and a set of weft strands 14 disposed at substantially right angles to each other. Each of the strands comprises a plurality of continuous filaments, composed for example of glass (an E-type glass is particularly suitable), carbon, aramid, or nylon fibers.

Figure 6:
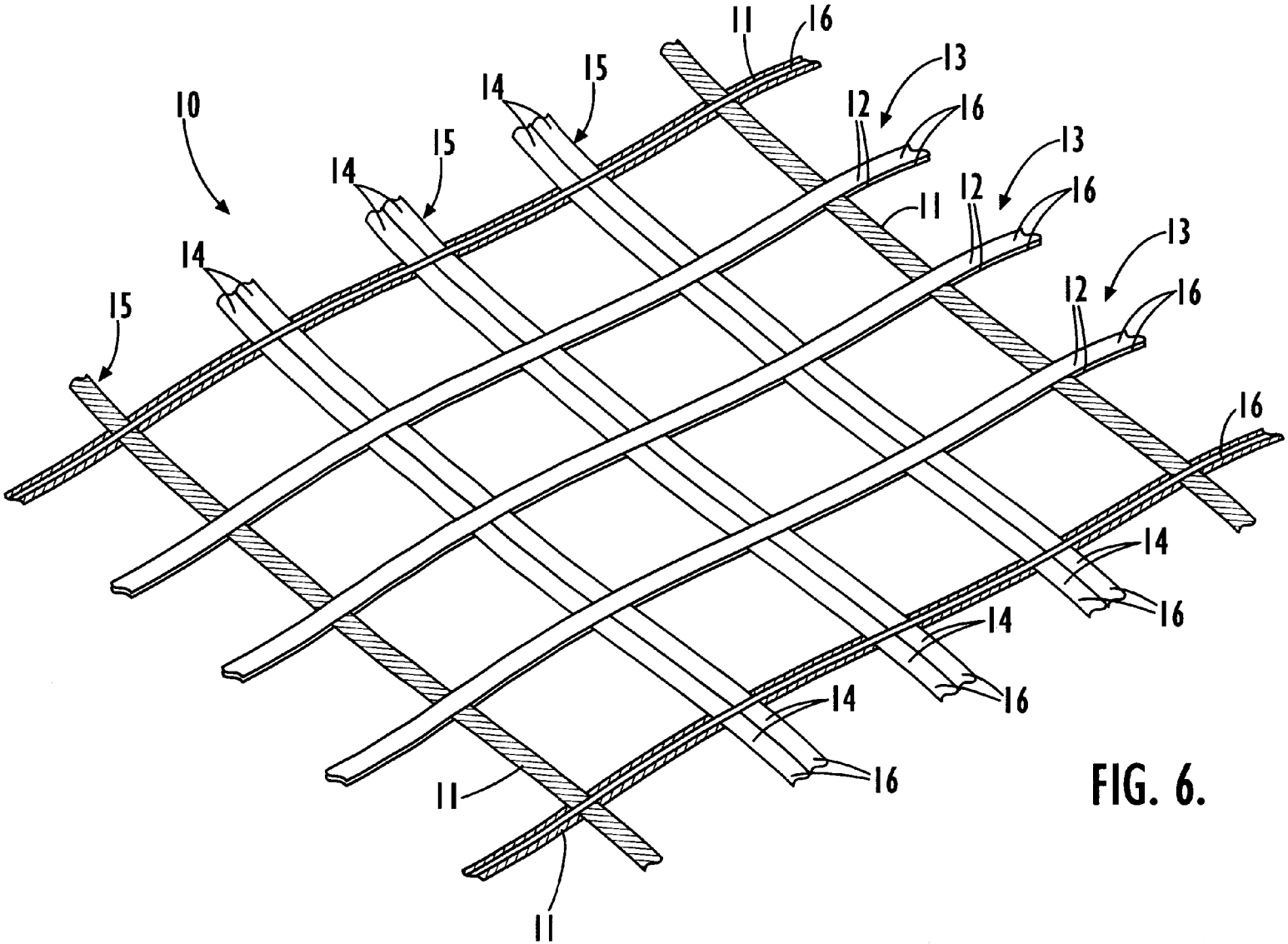
FIG. 6 is a perspective view of another embodiment of the structural reinforcing member according to the invention.

Advantageously, some of the strands 12, 14 of the grid are formed of a first type 11 of fibers and some of the other strands of the grid are formed of a second type 16 of fibers, as can be seen in FIGS. 1 and 6 which illustrate preferred embodiments. The first type 11 of fibers have a sufficiently high tensile modulus and stiffness to reinforce concrete structures after hardening of the concrete. The first type 11 of fibers also are resistant to alkaline attack and corrosion from the concrete over time. The use of carbon fibers as the first type of fibers has been found to be particularly useful.

The fibers of the second type 16 are, according to a preferred embodiment, formed of glass. The glass fibers are not as strong as the carbon fibers and are subject to alkaline attack and corrosion from the concrete material. In fact, glass fibers in concrete structures have been found to break up and lose all of the original strength of the fibers over a period of several years. However, glass fibers are significantly less expensive than carbon fibers. With the present invention, the advantages of both types of fibers are retained while the disadvantages are minimized. In particular, the glass fibers 16 may only serve a reinforcing function during handling of the gridwork 10 prior to being surrounded by the concrete or during the subsequent hardening process of the concrete. It may be the case that the glass fibers are sufficient to reinforce the concrete if the fibers are not attacked by the concrete. However, even if the glass fibers 16 subsequently corrode and lose all of their strength, the carbon fibers 11 will remain to reinforce the concrete. On the other hand, the use of a reinforcing grid 10 formed only partially of carbon fibers is much less expensive than a reinforcing grid formed entirely of carbon fibers.

The first and second types of fibers are not necessarily carbon fibers and glass fibers, however, and these fibers may comprise other compositions as noted above. To optimize performance of the glass fibers, they can be sized with a coating (e.g., silane) which has been shown to help resist the effects of alkali attack and also give excellent compatibility with the thermoset resin discussed below. The fibers of the grid may, alternatively or additionally, be coated with rubber (such as styrene butadiene rubber latex) and the like to minimize corrosion of the glass fibers. In addition, the reinforcing grid according to the present invention is not limited to use in concrete structures and can be used in other products such as asphalt roadways where the fibers can be subjected to other kinds of corrosive effects such as exposure to rainwater having a high concentration of road salt.

The set of warp strands 12 is separated into groups 13, each containing two contiguous strands in the illustrated embodiments. The set of weft strands 14 is separated into groups 15, each containing several contiguous strands in the illustrated embodiments of FIGS. 2, 3 and 6, although one of ordinary skill in the art would recognize that, as with the warp strands, each group may comprise only one strand. For example, FIG. 1 illustrates an embodiment where individual weft strands are separated from each other. The groups of strands of each set are spaced apart from each other so as to define an open structure. Also, it will be noted that in the illustrated embodiments, one strand of each group of the warp strands 13 lies on one side of the set of weft strands, and the other strand of each group of the warp strands 13 lies on the other side of the weft strands in a contiguous superimposed relationship. Thus, the sets of strands are non-interlaced. Also, the resulting superimposition of the warp strands achieves a "pinching or encapsulation" effect of the strands in the weft direction creating a mechanical and chemical bond at the crossover points.

The first type 11 and second types 16 of fibers can have various arrangements in the grid. For example the warp strands 12 or groups of warp strands 13 can alternate between fibers of the first type 11 and fibers of the second type 16, as illustrated in FIG. 1. Similarly, the weft strands 14 or groups of weft strands 15 can alternate between fibers of the first type 11 and fibers of the second type 16. All of the strands in the weft direction may be comprised of fibers of one of the two types. Alternatively, all of the strands in the warp direction may be comprised of fibers of one of the two types. It is even possible to include additional fibers not of the first or second types in either or both directions to achieve other advantages.

The particular embodiment illustrated in FIG. 6 includes one strand of carbon fibers 11 after every three groups of strands of glass fibers 16, in both the warp direction and the weft direction, such that every fourth strand is formed at least partly of carbon fibers. It is currently believed that a maximum spacing between neighboring carbon fiber strands is on the order of 2–2½ inches, although this spacing is dependent on a variety of factors, as would be appreciated by one of ordinary skill in the art. The glass fibers 16 are type 1715 available from PPG having a yield of 433 yards per pound and are arranged in bundles of two strands in each group. As explained above, the two warp strands 12 of each group 13 are disposed on either side of the weft strands 14. The strands of carbon fibers 11 can be formed of 48K tows (each having approximately 48,000 individual filaments) having a yield of 425 feet per pound. The carbon fibers 11 can also be supplied in 3K, 6K, 12K and 24K tows although, as would be appreciated by one of ordinary skill in the art, the larger fiber tows are sometimes more economical than the smaller fiber tows.

The embodiment illustrated in FIG. 1 includes weft strands 14 which are formed entirely of glass fibers 16 and warp strands 12 which include both carbon fibers 11 and glass fibers 16. The groups of warp strands 13 each comprise a pair of strands positioned one on either side of the weft strands 14 as discussed above. However, the groups of warp strands 13 alternate between groups where both of the warp strands are formed of glass fibers and groups where one of the strands comprises carbon fibers and the other comprises glass fibers. The carbon fiber strands 11 are all positioned on the same side of the weft strands 14 such that every alternating warp group 13 has a carbon strand on one side and a glass fiber strand on the other side. Accordingly, because the carbon fiber strands are so much stronger than the glass fiber strands, the glass fiber warp strands may function primarily to tie the glass weft strands to the carbon warp strands. Every alternating warp group 13 may also have carbon fiber strands 11 on both sides of the weft strands 14, which provides a high long term "crossover bond strength" at the intersections of the warp and weft strands.

The gridwork 10 may be impregnated substantially throughout with a thermosettable B-stage resin so as to interlock the strands at their crossover points and maintain the gridwork in a semi-flexible state which permits the gridwork to conform to the shape of the product to be reinforced. The gridwork is designed to be incorporated into a finished product such that the material is conformed to the shape or the functionality of the end-use product and then cured to form a structural composite. The ability of the gridwork to be conformed to the shape of the product allows the member to be cured by the inherent heat that is applied or generated in the ultimate construction of the finished product. For example, in the case of laying hot asphalt in paving roads or using hot asphalt for roofing systems, the thermosettable B-stage resin impregnated into the gridwork would be cured by the heat of the hot asphalt as used in these processes. The resin would be selected for impregnation into the grid such that it would cure by subjecting it to the hot asphalt at a predetermined temperature. Heat can be applied to cure or partially cure the grid before incorporation into concrete structures.

The crossover of the strands can form openings of various shapes including square or rectangular which can range from ½ to 6 inches in grids such as that shown in FIG. 1. FIG. 1 shows a square opening with dimensions of one inch in the warp direction and one inch in the weft direction. The size of the glass fiber bundles in each strand can vary. A range of glass strands with a yield from 1800 yards per pound up to 56 yards per pound can be used and, in particular, strands having yields of 247 yards per pound and 433 yards per pound.

The gridwork 10 may be constructed using a conventional machine, such as the web production machine disclosed in U.S. Pat. No. 4,242,779 to Curinier et al., the disclosure of which is expressly incorporated by reference herein.

A B-stage resin is a thermosetting type resin which has been thermally reactive beyond the A-stage so that the product has only partial solubility in common solvents and is not fully fusible even at 150°–180° F. Suitable resins include epoxy, phenolic, melamine, vinyl ester, cross linkable PVC, and isophthalic polyester. A common characteristic of all of these resins is that they are of the thermoset family, in that they will cross link into a rigid composite, which when fully cured cannot be resoftened and remolded. They also have the capability to be "B-staged", in which they are not fully cured and can be softened and reshaped either to conform to the shape of the end use product or corrugated into a three dimensional shape as described below. A preferred embodiment uses urethane epoxy resin applied to the flat open mesh scrim by means of a water emulsion.

A preferred method of producing the gridwork 10 includes applying the resin in a "dip" operation, as discussed in U.S. Pat. No. 5,836,715 which is incorporated herein by reference as noted above. In the "dip" operation, the resin in the bath is water emulsified with the water being evaporated by the subsequent nipping and heating operations. Resins which are capable of being "B-staged" as described above, are suitable, and the resins contemplated for this structural member are non-solvent based resins, and may or may not be water emulsified. Resins such as polyethylene or PPS may also be utilized. These resins would be applied in an emulsion type coating operation, and cured to a B-stage. Also, to a certain extent, the individual filaments themselves can be impregnated with the resin.

Impregnating the gridwork 10 with a thermosettable B-stage resin permits the gridwork to be semi-flexible and conform to the shape of the product to be reinforced, particularly with the application of heat. Once the gridwork is conformed to the shape of the product to be reinforced, the B-stage resin is cured to a thermoset state, providing upon cooling added rigidity and enhanced properties to the resulting product.

One of the advantages of the impregnated gridwork 10 is that it can be conformed to the shape of the product desired to be reinforced and cured in situ using the heat available in the normal manufacturing process, such as heated asphaltic concrete in asphaltic roadway construction. Alternatively, it may be cured by external heat, in which case it may be cured to a rigid state prior to incorporation into a finished product or supplemental heat can be applied after incorporation in the finished product, if desired.

Once cured, the gridwork is relatively rigid. This produces a structural member adapted to reinforce a product such as a pre-cast concrete part, base of asphalt overlay, etc. Such a rigid gridwork would be structurally composed of the same strand configurations and compositions as the flat grid-work impregnated with a B-stage resin, except that the B-stage resin has been advanced to a fully cured C-stage. The resulting rigid state of the gridwork provides added reinforcement to the product.

Another embodiment of the structural reinforcement member comprises a three-dimensional structural member as illustrated in FIG. 2 at 32. The three-dimensional structural member 32 may be formed by starting with the flat gridwork 10 impregnated with a B-stage resin described above and processing it into a three-dimensional structure according to techniques described in the '715 patent. More particularly, the set of warp strands 12 is corrugated into alternating ridges and grooves, while the set of weft strands 14 remains substantially linear.

The three-dimensional structural member 32 can accommodate a variety of parameters and grid configurations differing according to varying needs of different applications such as in concrete and asphalt road construction. Grid height can be varied to accommodate restrictions of end products. For example, grids for concrete will generally have a greater height than grids for asphalt paving primarily because of the need to reinforce the greater thickness of a new concrete road as compared to asphalt overlays which are usually only 2–2½ inches thick. In a new asphalt road construction, where the thickness of the overlay might be 5–11 inches, grids of greater height would be provided. Generally, asphalt is applied in asphaltic paving in a plurality of layers each being 2–5 inches thick, and as such the preferred grid for asphalt reinforcement would have a height between ½ and 4 inches. Grids of varying width can also be provided, for example, grids up to seven feet are presently contemplated, yet no restriction is intended on grids beyond this width by way of this example.

The three-dimensional structural member 32, with a thermosettable B-stage resin as described previously, permits the gridwork to be semi-flexible and conform to the shape of the product to be reinforced. Once the gridwork is conformed to the shape of the product to be reinforced, the B-stage resin would be cured providing added rigidity and enhanced properties to the resulting product. One of the advantages of the gridwork as disclosed in FIG. 2 is that it can be conformed to the shape of the product desired to be reinforced and cured in situ using either the heat available in the normal manufacturing process, such as heated asphaltic concrete in asphaltic roadway construction, or by heating from an external heat source. The structural member 32 could also be cured to a rigid state prior to incorporation into a finished product if desired. The gridwork could be cured thermally at a predetermined temperature depending on the particular resin.

The three-dimensional structural member 32 has many potential applications. A preferred embodiment is a method for fabricating a reinforced concrete or asphaltic roadway. Also, the three-dimensional gridwork can be used for reinforcing concrete structures in concrete precast slabs, for reinforcing double "T" concrete beams, concrete pipe, concrete wall panels, and for stabilization of aggregate bases such as rock aggregate used as a sub-base in road construction.

Figure 3:
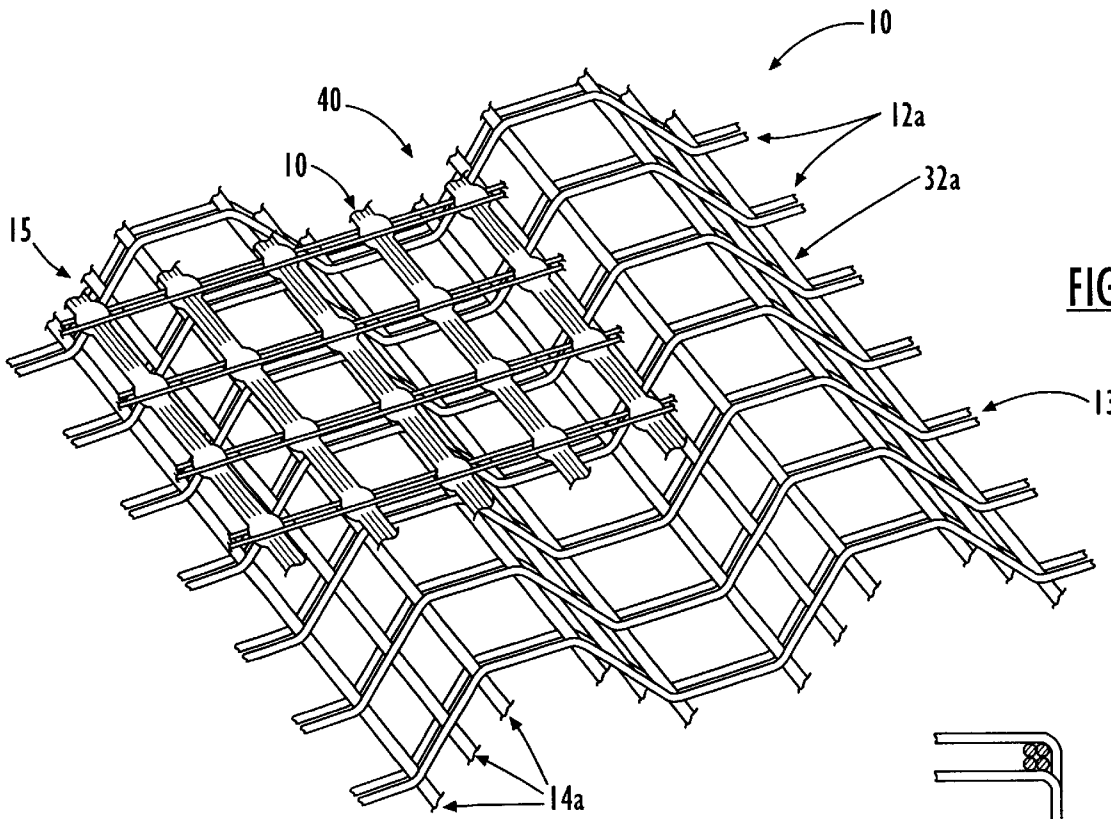
FIG. 3 is a perspective view of a structural member adapted to reinforce a product comprising another embodiment of the present invention.

FIG. 3 shows another embodiment of a three-dimensional structural composite member 40 adapted to reinforce a product, and which embodies the present invention. This embodiment comprises a three-dimensional corrugated member 32*a* which is similar to the member 32 as described above, but wherein the corrugations of the warp strands 12*a* are inclined at about 45° angles, rather than substantially vertical as in the member 32. Also, the number and placement of the weft groups 14*a* is different. As illustrated, the member 32*a* is used in conjunction with a generally flat gridwork 10 as described above. Specifically, the generally flat gridwork 10 is positioned to be coextensive with one of the planes of the three-dimensional gridwork.

The three dimensional composite member 40 can be impregnated with a B-stage resin as described above, or alternatively, it can be fully cured prior to incorporation into a product to be reinforced, such as Portland cement concrete products as further described below.

Figure 4:
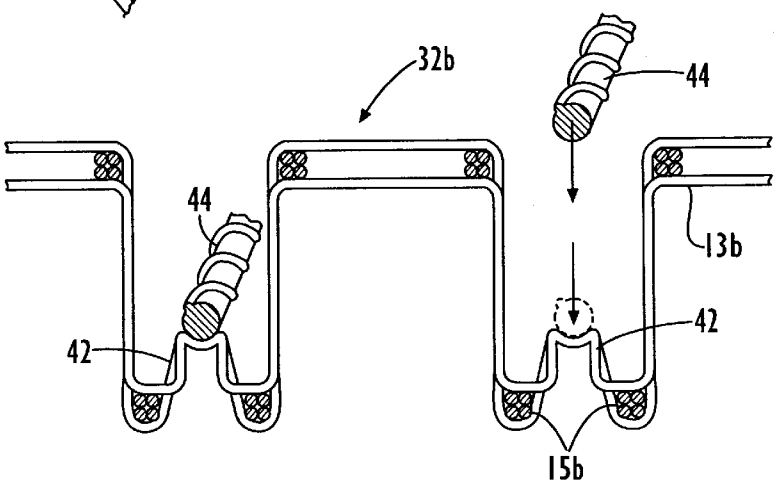
FIG. 4 is a perspective view of an embodiment of a structural member of the present invention and which is adapted for use with metal or fiber glass rebars.

Another embodiment of the invention is illustrated in FIG. 4, and comprises a three dimensional structural reinforcement member 32*b* comprising gridwork of a construction very similar to that illustrated in FIG. 2, and which comprises groups of warp strands 13*b* and groups of weft strands 15*b* disposed at right angles to each other. The member 32*b* further includes specific positions 42 molded into the warp strands of the gridwork to allow steel or fiber glass rebars 44 to be placed in at least some of the grooves of the corrugations and so as to extend in the direction of the corrugations. In the preferred embodiment, these positions would allow the steel or fiber glass rebars 44 to be placed between the upper and lower surfaces defined by the corrugations, and thus for example approximately 1 inch from the foundation or surface upon which the corrugated grid structure was placed. After placing the steel or fiber glass rebars on these molded in positions 42, additional steel rebars (not shown) could be placed at right angles to the original steel rebars and on top of them holding them in place by tying them to the "Z-axis" fibers of the composite corrugated gridwork. The main benefit to the "molding in" of the positions 42 into the corrugated composite gridwork is to allow the steel or fiber glass rebars to be placed a distance from the foundation or base upon which the corrugated gridwork is placed. In placing steel rebars conventionally in products such as bridge decks, it is common to use small plastic chairs in order to position the steel rebars so that they are not lying on the foundation, but are positioned approximately 1–2 inch up off of the foundation These separate chairs are not required with the embodiment of FIG. 4.

Methods for Utilizing the Structural Reinforcement Member

The several embodiments of the structural reinforcement members as described above can be utilized in a variety of methods for reinforcing various products. One method involves providing the gridwork impregnated with a B-stage resin as described, applying the gridwork to the product in conforming relation, and then applying heat to the product so as to cure the resin and convert the same into a fully cured resin to thereby rigidify the gridwork and reinforce the product. Any product where the advantage of having a semi-rigid open reinforcement which could be cured in situ would be a potential application in which this method could be used. Therefore the embodiments contained herein by way of example do not limit such methods and uses.

The use of the flat grid and three-dimensional grid in conjunction, as shown in FIG. 3, would serve to unitize the three-dimensional composite grid in the direction of corrugation and to allow workers in the field to be able to better walk on the material as the concrete is being pumped through the grid structure to form the finished concrete road. The flat grid can be laid on top of the three-dimensional grid, and fastened with fastening means such as metal or plastic twist ties in order to better hold the flat grid structure to the top of the corrugated grid structure. Also, in concrete road construction a flat composite grid could be positioned beneath the three-dimensional corrugated grid structure to give added structural integrity to the three-dimensional structure.

The three-dimensional gridwork is versatile in allowing the contractor to tailor the amount of desired reinforcement in the concrete road by nesting the corrugated three-dimensional structures one on top of the other. This would still allow concrete flow through the openings in the grid structure, but would provide a means to increase the amount of reinforcement in the concrete.

The embodiments of the novel gridwork as described herein have a variety of uses, in addition to reinforcing roadway surfaces. For example, decayed telephone poles can be rehabilitate, with the heat mechanism for cure being a hot asphalt matrix or possibly additional external heat for full cure. Another embodiment of the invention comprises a method for fabricating reinforced concrete columns with better performance in seismic regions with the heat cure provided by an external heater or by a hot asphalt matrix overcoat.

The gridwork of the present invention, when fully cured as described above, is particularly useful in reinforcing a structure composed of a concrete material, such as Portland cement concrete. For example, in the case of new roadway construction, the foundation is prepared and the fully cured gridwork is placed upon the foundation. Thereafter, the liquid concrete is poured upon the foundation so as to immerse the gridwork, and upon the curing of the concrete, a reinforced concrete roadway is produced with the gridwork embedded therein.

Figure 5:
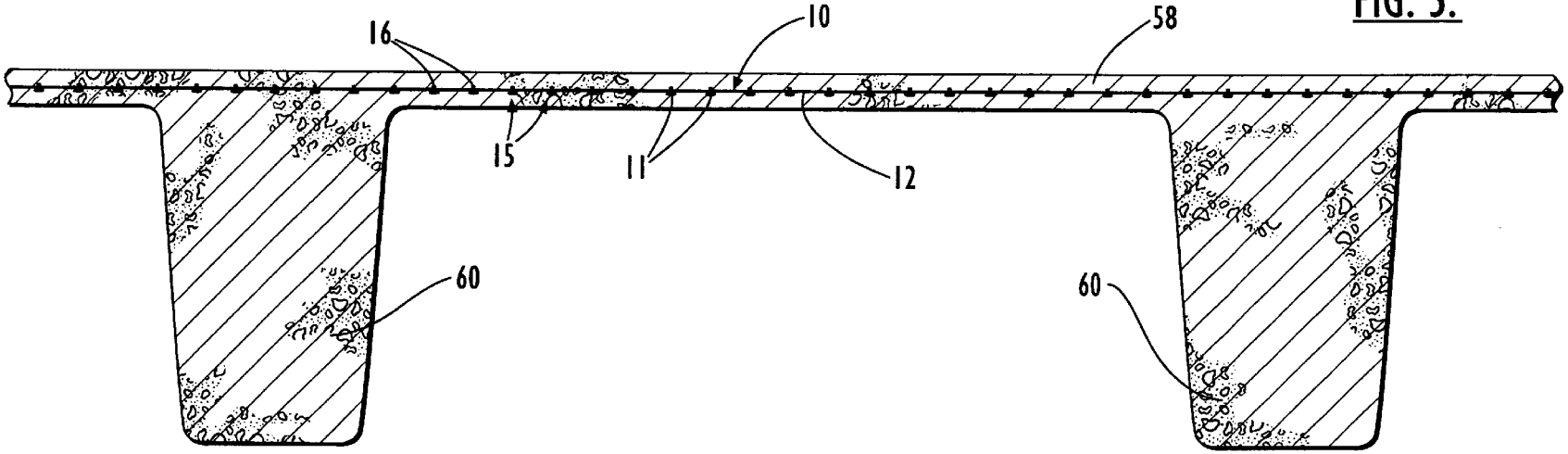
FIG. 5 is a cross sectional view of a thin walled concrete panel structure reinforced with a reinforcing grid according to the invention.
Figure 5A:
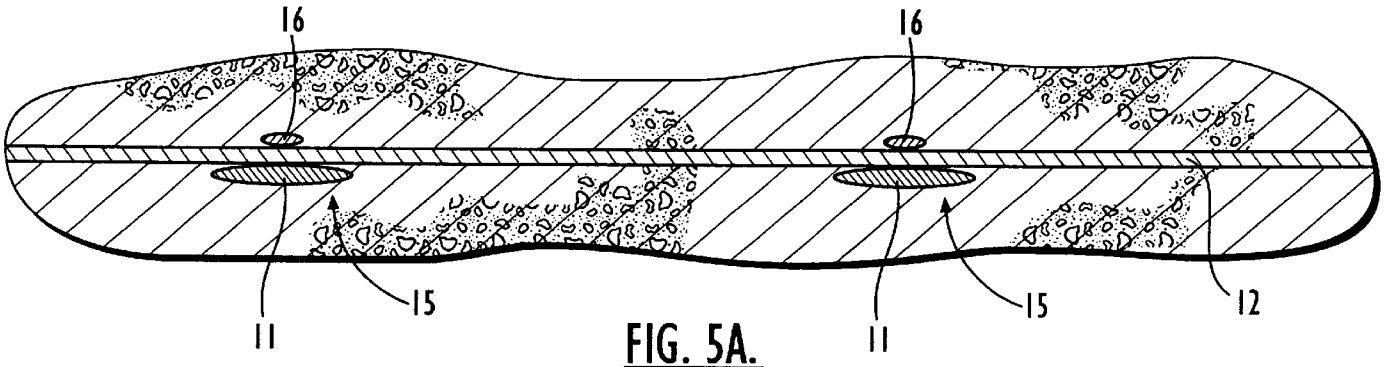
FIG. 5A is a greatly enlarged cross sectional view of the thin walled panel according to FIG. 5 and illustrating the reinforcing grid in more detail.

Another concrete product utilizing the reinforcing grid 10 according to the present invention is illustrated in FIG. 5. In certain applications, it is desirable to make concrete structures having thin wall panel sections 58. For example, panels 58 which do not require extremely high strength, and/or panels which are reinforced with one or more ribs 60, are sometimes thicker than desired because of the limitations on conventional steel reinforced concrete. As mentioned above, typically at least one inch of concrete thickness is needed on either side of the reinforcing steel to cover the steel sufficiently to ensure that corrosion of the steel will not lead to spalling of the concrete. However, with the structural member according to the present invention, the materials used for the reinforcing grid will not corrode in a manner which causes spalling of the covering concrete when the covering concrete is less than one inch in thickness. In addition, the reinforcing grid 10 has a total thickness significantly less than the thickness of conventional reinforcing steel. Accordingly, concrete panels 58 or sections of panels having a thickness of less than three inches, and even as thin as ¾ to 1 inch, can advantageously be made with the reinforcing grid according to the invention.

Another use for the present invention involves a method of reinforcing asphaltic roofing, either as a prefabricated single-ply sheeting or as a conventional built-up roofing. During formation of the roofing, the heat of the hot asphalt will cure the B-staged resin to the C-stage. The result is a stronger roofing that will resist sagging or deformation and rupture by walking or rolling traffic on the roofing.

In the drawings and the specification, there have been set forth preferred embodiments of the invention and, although specific terms are employed, the terms are used in a generic and descriptive sense only and not for the purpose of limitation, the scope of the invention being set forth in the following claims.

That which is claimed:

1. A structural member for reinforcing a product formed of a hardenable structural material after hardening of the material, said structural member being in the form of a reinforcing grid including first and second types of fibers in which one of said types of fibers has a higher strength sufficient to reinforce the hardenable material after hardening and a higher resistance to degradation in the hardenable material than the other type of fibers and the other of said types of fibers is less expensive than the one type of fibers to reduce the cost of said structural member, said reinforcing grid comprising:

a set of warp strands wherein at least some of said warp strands are spaced apart, and at least some of said warp strands are formed of fibers of one of said first or second type of fibers;

a set of weft strands wherein at least some of the strands are spaced apart and disposed at substantially right angles to said set of warp strands to define an open structure through which the hardenable material can pass before hardening, and at least some of said weft strands are formed of the other of said first or second types of fibers;

whereby, said gridwork is partially formed of fibers of the first type which will continue to reinforce the hardened material in the event the fibers of the second type become corroded in the hardened material.

2. A structural member as defined in claim 1 wherein the fibers of the first type comprise carbon fibers.

3. A structural member as defined in claim 1 wherein the fibers of the second type comprise glass fibers.

4. A structural member as defined in claim 1 wherein the set of warp strands is separated into groups each containing a plurality of contiguous strands, with at least one strand of each group lying on one side of the set of weft strands and at least one other strand of each group lying on the other side of the set of weft strands in a superimposed relationship.

5. A structural member as defined in claim 4 wherein the warp strand lying on one side of the weft strands comprises fibers of the first type and wherein the warp strand lying on the other side of the weft strands comprises fibers of the second type.

6. A structural member as defined in claim 4 wherein the warp strand lying on one side of the weft strands comprises fibers of the first type and wherein the warp strand lying on the other side of the weft strands also comprises fibers of the first type.

7. A structural member as defined in claim 1 wherein the sets of strands are non-interlaced.

8. A structural member as defined in claim 1 wherein the grid is impregnated substantially throughout with a thermosettable B-stage resin so as to interlock the strands at the crossover points of the strands and maintain the grid in a semi-flexible state which permits the grid to conform to the shape of the product to be reinforced.

9. A structural member as defined in claim 1 wherein the grid is impregnated substantially throughout with a fully cured thermoset resin so as to interlock the strands at the crossover points of the strands and maintain the grid in a relatively rigid state.

10. A structural member as defined in claim 9 wherein said resin is selected from the group consisting of epoxy, phenolic, melamine, vinyl ester, cross linkable PVC, and isophthalic polyester.

11. A structural member as defined in claim 1 wherein the set of warp strands and the set of weft strands are substantially linear, so that the gridwork is generally flat.

12. A reinforced structural product comprising:

a hardened structural material formed into the desired final shape of the structural product; and a reinforcing grid including first and second types of fibers in which one of said types of fibers has a higher strength sufficient to reinforce said hardened structural material after hardening and a higher resistance to degradation in said hardened material than the other type of fibers and the other of said types of fibers is less expensive than the one type of fibers to reduce the cost of said reinforcing grid, said reinforcing grid comprising a set of warp strands wherein at least some of said warp strands are spaced apart and at least some of said warp strands are formed of fibers of one of said first or second type of fibers; a set of weft strands wherein at least some of the strands are spaced apart and disposed at substantially right angles to said set of warp strands to define an open structure through which the hardenable material can pass before hardening and at least some of said weft strands are formed of the other of said first or second types of fibers;

whereby, said gridwork is partially formed of fibers of the first type which will continue to reinforce the hardened material in the event the fibers of the second type become corroded in the hardened material.

13. A reinforced structural product as defined in claim 12 wherein the fibers of the first type comprise carbon fibers.

14. A reinforced structural product as defined in claim 12 wherein the fibers of the second type comprise glass fibers.

15. A reinforced structural product as defined in claim 12 wherein the set of warp strands is separated into groups each containing a plurality of contiguous strands, with at least one strand of each group lying on one side of the set of weft strands and at least one other strand of each group lying on the other side of the set of weft strands in a superimposed relationship.

16. A reinforced structural product as defined in claim 15 wherein the warp strand lying on one side of the weft strands comprises fibers of the first type and wherein the warp strand lying on the other side of the weft strands comprises fibers of the second type.

17. A reinforced structural product as defined in claim 15 wherein the warp strand lying on one side of the weft strands comprises fibers of the first type and wherein the warp strand lying on the other side of the weft strands also comprises fibers of the first type.

18. A reinforced structural product as defined in claim 12 wherein the sets of strands are non-interlaced.

19. A reinforced structural product as defined in claim 12 wherein the grid is impregnated substantially throughout with a thermosettable B-stage resin so as to interlock the strands at the crossover points of the strands and maintain the grid in a semi-flexible state which permits the grid to conform to the shape of the product to be reinforced.

20. A reinforced structural product as defined in claim 12 wherein the grid is impregnated substantially throughout with a fully cured thermoset resin so as to interlock the strands at the crossover points of the strands and maintain the grid in a relatively rigid state.

* * * * *

UNITED STATES PATENT AND TRADEMARK OFFICE
Certificate

Patent No. 6,263,629 B1 Patented: July 24, 2001

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Gordon L. Brown, Jr., Anderson, SC; and Harold G. Messenger, Rehoboth, MA.

Signed and Sealed this Sixteenth Day of September 2003.

CARL FRIEDMAN
*Supervisory Patent Examiner*
Art Unit 3635